United States Patent [19]

Tyson et al.

[11] 3,937,583

[45] Feb. 10, 1976

[54] PAINT ROLLER

[75] Inventors: James D. Tyson, Carthage; R. G. Harris, Lexington, both of N.C.

[73] Assignee: Tyson Paint Roller Company, Inc., Carthage, N.C.

[22] Filed: July 22, 1974

[21] Appl. No.: 490,579

Related U.S. Application Data

[63] Continuation-in-part of Ser. No. 310,324, Nov. 29, 1972, abandoned.

[52] U.S. Cl. ..... 401/197

[51] Int. Cl. ..... B44d 3/28

[58] Field of Search ..... 401/197; 15/230.11

[56] References Cited

UNITED STATES PATENTS

| | | | |
|---|---|---|---|
| 2,684,497 | 7/1954 | Graham | 401/197 |
| 2,708,763 | 5/1955 | Jacoby | 401/197 X |
| 2,984,853 | 5/1961 | Williams | 15/230.11 |
| 3,386,124 | 6/1968 | Feine | 15/230.11 |
| 3,436,161 | 4/1969 | Charos | 401/197 X |
| 3,593,361 | 7/1971 | Welt | 15/230.11 |

*Primary Examiner*—Lawrence Charles
*Attorney, Agent, or Firm*—Mills and Coats

[57] ABSTRACT

In abstract, a preferred embodiment of this invention is an improved paint roller of the type wherein the interior of such roller is a reservoir for paint. This roller is of simplified design, can be produced out of plastic, and is highly efficient to use.

3 Claims, 6 Drawing Figures

FIG. 4
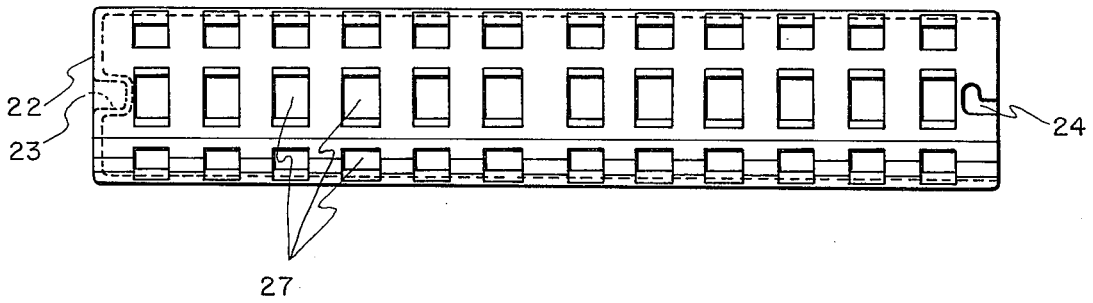
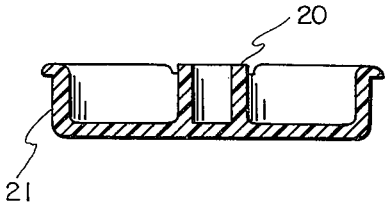
FIG. 6
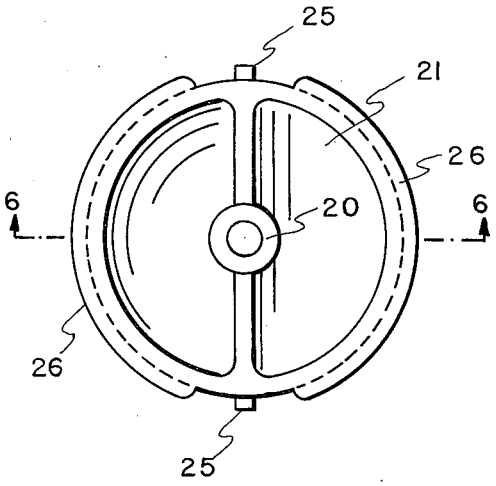
FIG. 5

PAINT ROLLER

This application is a continuation-in-part of U.S. Patent application Ser. No. 310,324, filed Nov. 29, 1972 and now abandoned, for PAINT ROLLER by James D. Tyson.

This invention relates to painting devices and more particularly to reservoir type paint rollers.

In the past, various types of paint rollers have been devised to aid in the applying of paint to surfaces to be painted. These rollers have been considered much faster in applying a coat of paint than the heretofore widely used paint brush. With the development of long nap rollers for applying paint, the painting process has generally been greatly speeded up. These rollers, however, are generally used in conjunction with a pan-like container which holds the liquid paint and into which the roller must be dipped and moved back and forth to absorb an adequate amount of paint to be applied to the surface being painted.

To overcome this messing and laborious part of using a paint roller for applying paint, such devices have been developed as pressurized paint containers wherein paint is forced through a tube or hose into the interior of the roller. The purpose of this is to allow continuous paint to flow from the surface of the roller but invariably these units produce either too little or too much paint on the surface of the roller thus causing either skipped spots or dripping. Also, the problem of moving the paint pumping mechanism and reservoir as the painting process proceeds has been a constant problem which has made such systems generally impractical.

Attempts have been made in incorporating the reservoir for the paint in either the handle or in the interior of the roller itself. These systems have proved impractical for a number of reasons and have certainly not been commercially accepted. They have been generally complicated in operation, messy to clean and inoperative if not properly cared for. Additionally, these prior units have been relatively expensive to produce both in manufacturing and maintenance cost. These prior known units have also not been in any way considered expendable or throw-away type units.

After much research and study into the above mentioned problems, the present invention has been developed to provide an extremely inexpensive paint roller which is capable of acting as a nondrip reservoir for paint as well as an applicator. The present invention is highly efficient in function and is superior in application to more complex complicated and expensive units.

In view of the above, it is an object of the present invention to provide an inexpensive yet highly efficient reservoir type paint roller.

Another object of the present invention is to provide a reservoir type paint roller designed to be produced exclusively from plastic type material.

Another object of the present invention is to provide a reservoir type paint roller which is light in weight and yet strong in design.

Another object of the present invention is to provide a reservoir type paint roller wherein the forks supporting such roller are biased inwardly toward each other during normal use.

Another object of the present invention is to provide, in a reservoir type paint roller, a quick disconnect roller from support fork system.

Another object of the present invention is to provide, in a reservoir type paint roller, a nondrip paint container means.

Other objects and advantages of the present invention will become apparent and obvious from a study of the following description and the accompanying drawings which are merely illustrative of such invention.

IN THE DRAWINGS

FIG. 4 is an elevational view of the roller-reservoir of the present invention;

FIG. 5 is a elevational view of the roller closure of the present invention; and FIG. 6 is a sectional view taken through lines 6—6 of FIG. 5.

With further reference to the drawings, the improved painting device of the present invention, indicated generally at 10, is composed of a generally U-shaped roller supporting bail 11 with an integral handle 12 so formed as to project outwardly from the center section thereof.

The bail and handle are preferably formed from a plastic type material as an integral, molded unit. To give added strength, reenforcing partitions 13 are provided in the bail portion. These partitions extend in a zig-zag pattern across the interior of the bail since the same is generally U-shaped in cross section as is seen particularly clear in FIG. 3.

Figure 3:
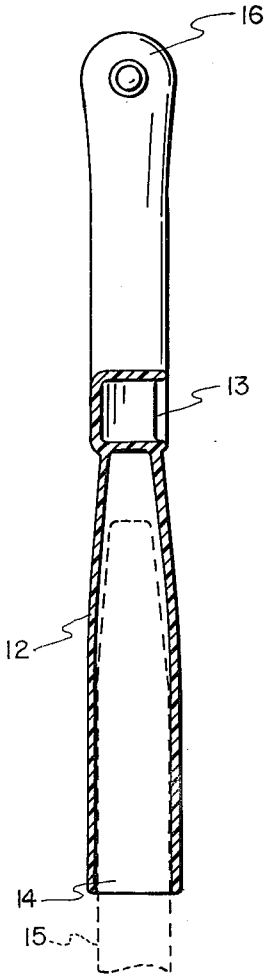
FIG. 3 is a sectional view taken through lines 3—3 of FIG. 2.
Figure 2:
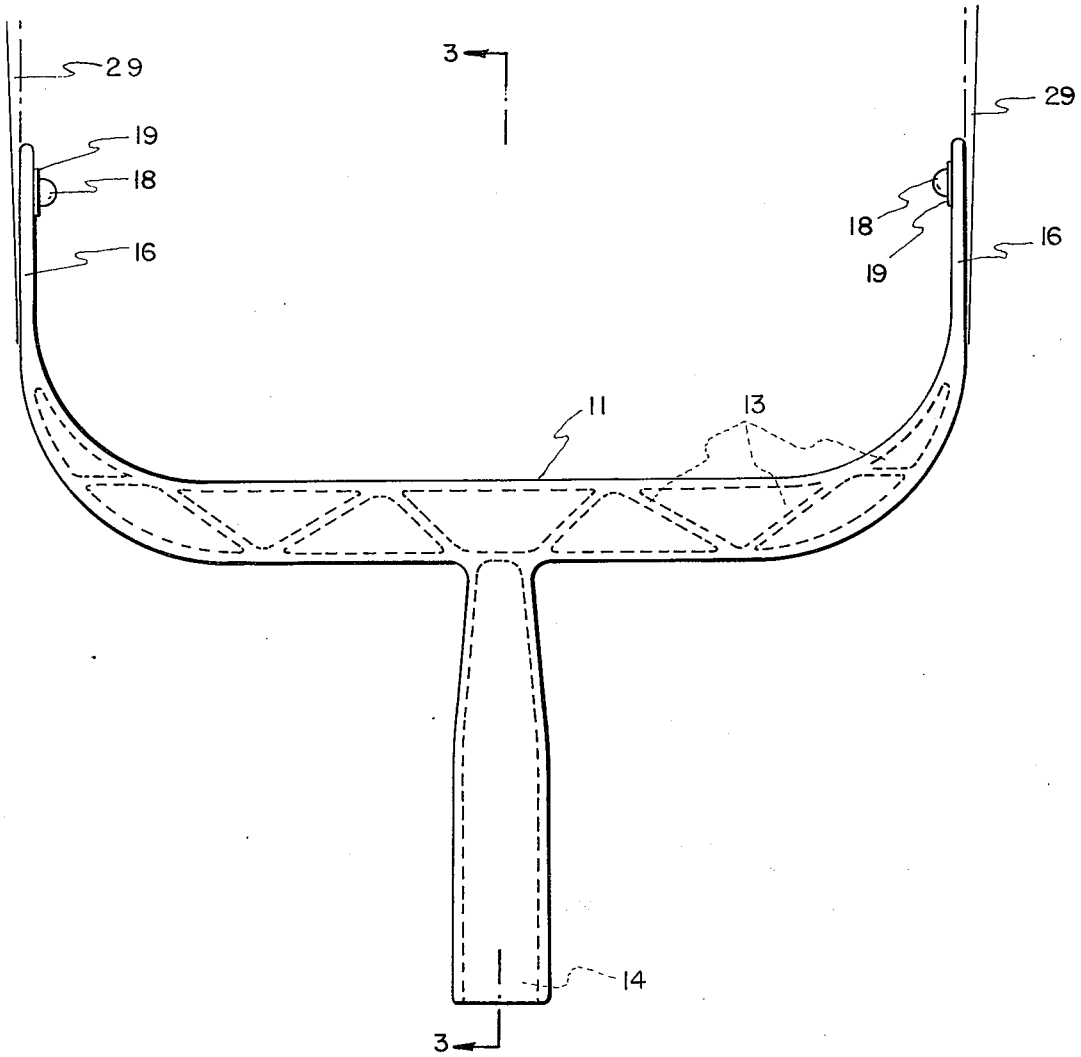
FIG. 2 is a botton plan view of the same.

As is clearly seen in FIGS. 2 and 3, the handle 11 is interiorly hollow and is tapered inwardly from opening 14. This tapering allows an extension handle such as that shown in dotted lines in FIG. 3 to be jammingly inserted into the opening. The purpose of the extension handle 15 is to allow areas generally out of reach of the user of the painting device 10 of the present invention to have access to such areas.

From FIG. 2 it can be noted that in rest position the outer ends 16 of bail 11 are toed inwardly, each from parallel approximately 5°. When the reservoir-roller 17 is in operative position, these outer ends 16 will be forced to a parallel position thus placing an inward bias on such reservoir-roller. This, of course, retains the last mentioned apart in position.

From FIG. 3, it can be clearly seen that outer ends 16 are flared and rounded. This flaring gives greater strength and abutting surface between the supporting bail 11 and the reservoir-roller 17.

Inwardly projecting nipples 18 are either fixedly secured or integrally formed into the inner facing portion of the outer ends 16 of bail 11. These nipples are circular in cross section and preferably rounded on their ends to aid in quick mounting of the reservoir-roller thereon.

About the base of each of the inwardly projecting nipples 18 is provided a washer-shaped bearing surface 19 which is adapted to rotatively contact bearing surface 20 of either end cap 21 or reservoir end 22 as the case may be.

Figure 1:
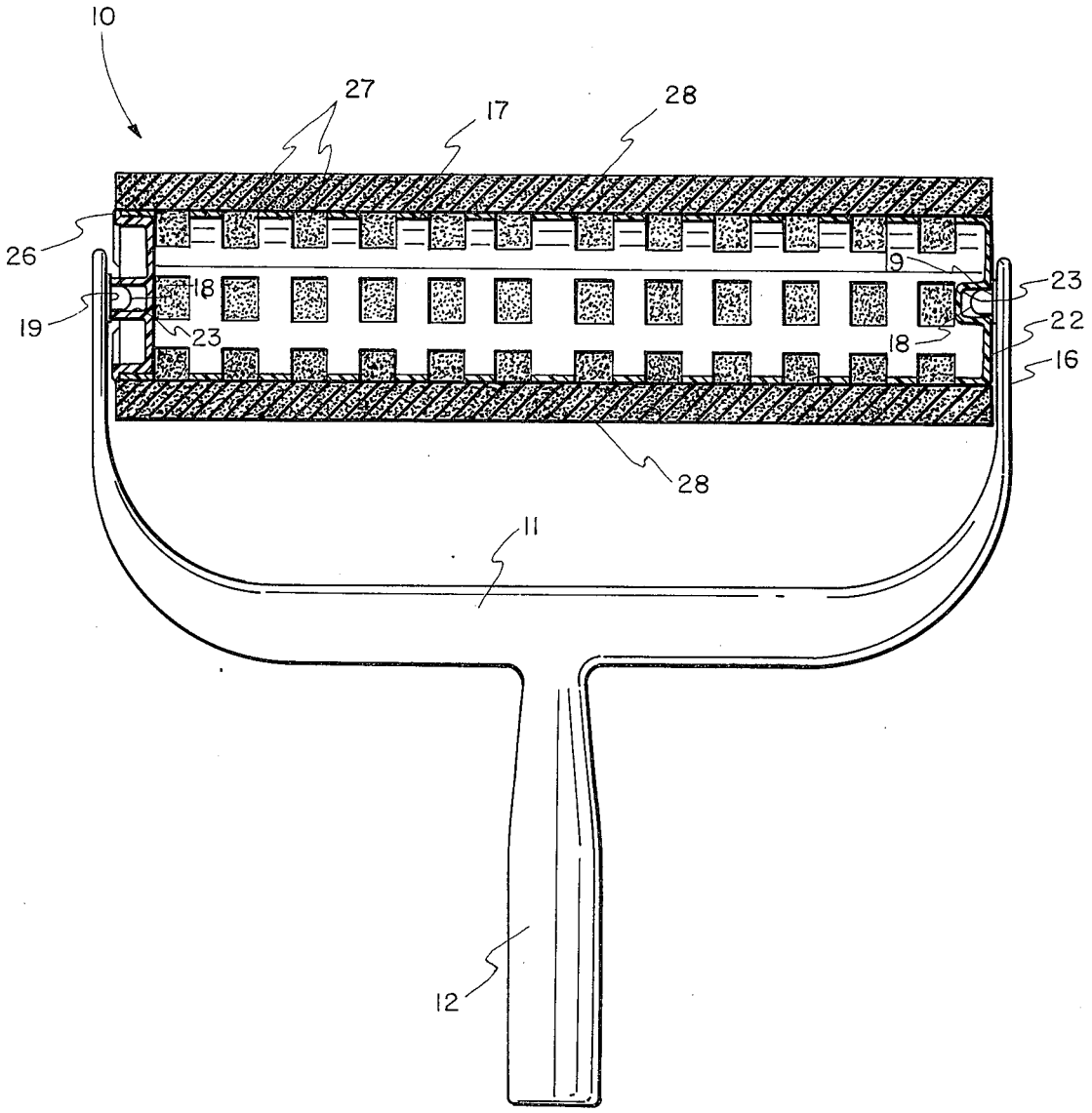
FIG. 1 is a top plan view of the paint roller of the present invention with the roller portion thereof being shown in section.

The reservoir-roller 17 is preferably formed of plastic and is in a generally cylindrical shape with the end 22 being integral therewith as seen particularly clear in the sectional portion of FIG. 1. The opening or dimple 23 in end cap 22 is, of course, adapted to receive one of the nipples 18 of bail 11.

End cap 21 is so sized as to snugly fit into the ordinarily open end of reservoir-roller 17 and is held in retained position by a pair of generally J-shaped slots 24 formed on opposite sides of such reservoir-roller and which are adapted to releasably retain projections 25 of the cap.

The end cap 21 clearly seen in FIGS. 5 and 6 includes outwardly projecting peripheral flanges 26 which assure proper positioning of the cap relative to the reservoir.

The reservoir-roller 17 includes a plurality of generally rectangular openings 27 formed in a geometric pattern in its side walls. These openings allow paint contained within the reservoir-roller to pass through such sides and to be absorbed by the flexible, open celled foam covering is provided thereover. This covering can, of course, be formed from any one of a number of materials well known to those skilled in the art and readily commercially available. This covering is cylindrical in shape, open at both ends and so sized to snugly fit over roller-reservoir 17. The cover allows paint to absorb therethrough in adequate amounts to cover the surface being painted but not so much as to cause dripping. The cylindrical covering 28 also is preferably seamless or, if seamed, is so formed in construction as not to leave evidence thereof when the roller is applying paint to a surface.

The painting device of the present invention is preferably shipped to the retail outlet with the reservoir-roller disassembled from the supporting bail. When the purchaser is ready to use the painting device, all he need do is to slide the cylindrical cover 28 onto the exterior of reservoir-roller 17 (the cover being preferably removable for easier cleaning) and such reservoir is ready for filling. Paint can then be poured in the cavity end of the reservoir-roller until the same is at the desired filling level. End cap 21 is then so positioned that the projections 25 on either side thereof slide into the J-shaped slots 24 provided in opposite sides of the reservoir-roller 17. Then with a simple twist of the cap, the projections lock into the curved portion of the J-slots thus assuring that such cap will not become dislodged. The peripheral flanges 26 at this point are in engagement with the end of the reservoir-roller 17 as seen clearly in the section portion of FIG. 1.

Once the end cap 21 is in place on the filled reservoir-roller, the outer ends 16 of the bail 11 are moved away from each other an adequate amount so that nipples 16 can be slipped into rotative engagement with their respective dimples 23. Once the spreading pressure on the outer ends 16 is released, because of the natural spring biased in the bail 11, such ends move inwardly for snug retaining engagement with the roller-reservoir 17. This inward biasing of the bale ends not only retain the roller in a rotative position about nipples 18 but also assures that the end cap 21 will remain in proper closure position. This is an added safety feature to prevent spills over and above the J-shaped locking means.

If the surface to be painted is beyond the normal reach of the user of the same, a tapered extension handle 15 can be jammingly inserted into opening 14 in handle 12 thus allowing the painting device 10 of the present invention to be manipulated on relatively remote surfaces.

Whether the handle 15 is or is not used once the paint filled roller-reservoir is in place, the same is ready for operation. The paint within the interior of the reservoir will absorb outwardly through the openings 27 and through cover 28 to the exterior thereof. Because this cover is of relatively medium absorption material, it will capillarily absorb outwardly an adequate amount of paint that, when such roller is rolled over a surface, a layer of paint will be evenly distributed thereon and yet is not of such absorption quality that excessive dripping will occur.

The painting device of the present invention provides a dripless, painting means which does not have to be dipped, squeezed or otherwise manipulated but only needs to be rolled along over the surface to be painted to deposit an even coat thereon. The replenishing of paint in the painting cover 28 is done by capillary action from the interiorly disposed paint. It is only after an extensive surface has been painted that the user of the same will have to stop to refill the paint supply within the interior of the reservoir-roller. If, of course, the entire area to be painted has been completed and some paint remains within the interior of the reservoir, all that is required to salvage the same is to remove the roller-reservoir 17 from bail 11, unlock and remove cap 21, and pour such paint back into its bucket or other suitable container.

At the end of the painting operation, the excess is removed from the interior of the reservoir-roller as indicated above and then the same can be cleaned in the standard manner using whatever solvent is required for the particular type of paint used. To aid in the cleaning operation, the cover 28 can be slipped off of the exterior of the reservoir-roller and cleaned separately. This allows the openings 27 in the wall of the reservoir-roller to be completely cleaned to prevent dry paint build-up.

It is, of course understood that in using certain types of paint the removal of the cover 28 may not be necessary to adequately clean the device.

The removability of the cover 28 may at times also have the advantage of allowing the user of the painting device 10 of the present invention to change colors without dilution of the same from reuse of the old cover.

The painting device of the present invention can be formed from any suitable type of moldable plastic such as impact styreme. Likewise, the cover can be formed from any suitable absorbent type material such as a flexible, open cell foam type material.

From the above, it is obvious that the present invention has the advantage of providing an improved painting device which can be readily molded and provides an inexpensive and yet highly efficient reservoir type paint roller means. Because of this, the present invention is inexpensive to produce and thus the savings can be passed on to the ultimate user thereof.

The present invention may, of course, be carried out in other specific ways than those herein set forth without departing from the spirit and essential characteristics of the invention. The present embodiments are, therefore, to be considered in all respects as illustrative and not restrictive, and all changes coming within the meaning and equivalency range are intended to be embraced herein.

What is claimed is:

1. An improved painting device comprising: a generally Y-shaped bail and handle unit integrally formed from a molded plastic type material and wherein the bail portion of the bail and handle unit is generally U-shaped in cross section and contains a plurality of integral partitions extending across said U-shaped cross section whereby a strong lightweight unit is produced and wherein the outer ends of the bail portion of the bail and handle unit are toed inwardly toward each other in normal rest position whereby when moved outwardly apart, an inwardly biasing effect is obtained; an axial opening provided in the end of the handle opposite the bail whereby a handle extension can be retainingly inserted thereinto; inwardly projecting nipples fixedly secured one on each end of the bail portion of said unit; a perforate, generally cylindrical shaped reservoir-roller closed at one end and formed from a moldable, plastic type material; and end cap removably insertable in the open end of said cylinder; a dimple-like depression centrally formed in the exterior of the closed end of said reservoir-roller; a dimple-like depression centrally formed in the exterior of said end cap whereby each of said dimple-like depressions rotatably engage one of said dimples thereby rotatably supporting said reservoir-roller on said bail and handle unit; and an absorbent covering disposed around said cylindrical shaped reservoir-roller whereby paint contained therein can be applied to a surface to be painted.

2. The device of claim 1 wherein the bail and handle unit is formed from impact styrene type plastic material.

3. The device of claim 1 wherein the reservoir-roller is formed from impact styrene type material.

* * * * *